US005806259A

United States Patent [19]

Smith

[11] Patent Number: 5,806,259

[45] Date of Patent: Sep. 15, 1998

[54] EXTERNALLY REINFORCED SINGLE SPAN BEAM

[76] Inventor: Raymond H. Smith, Rte. 2-5AAA, Larned, Kans. 67550

[21] Appl. No.: 701,738

[22] Filed: Aug. 22, 1996

[51] Int. Cl.[6] ..... E04C 3/10

[52] U.S. Cl. ..... 52/223.12; 52/223.13; 52/223.14

[58] Field of Search ..... 52/223.8, 223.12, 52/223.14, 223.13

[56] References Cited

U.S. PATENT DOCUMENTS

| | | | |
|---|---|---|---|
| 2,856,644 | 10/1958 | Dunham | 52/223.12 |
| 3,427,773 | 2/1969 | Kandall | 52/223.12 |

FOREIGN PATENT DOCUMENTS

| | | | |
|---|---|---|---|
| 1544207 | 9/1968 | France | 52/223.8 |

*Primary Examiner*—Michael Safavi

*Attorney, Agent, or Firm*—Litman, McMahon & Brown, L.L.C.

[57] ABSTRACT

An apparatus for reinforcing a structural member such as a beam or joist comprises a cable which is secured under tension to anchor brackets mounted on opposite ends of a beam. The cable extends across a face of the beam and across and in engagement with a bearing bracket mounted to the face of the beam intermediate its ends. The cable engages a cable engaging member on the bearing bracket and bears upward thereon. The cable thereby bears a portion of the load applied to the beam intermediate its ends, resisting distortion of the beam and providing increased recovery ability. First and second tension adjustment mechanisms are securable to the beam to engage the cable on opposite sides of the bearing bracket respectively to permit the tension on the cable to be adjusted. At least one end of the cable may be secured to an adjustable anchor bolt on the respective anchor bracket to further permit adjustment of the tension on the cable. A preferred embodiment includes an upper and a lower cable extending under tension between anchor brackets and across and in engagement with the bearing bracket.

4 Claims, 3 Drawing Sheets

EXTERNALLY REINFORCED SINGLE SPAN BEAM

BACKGROUND OF THE INVENTION

The present invention relates to an apparatus for reinforcing structural members such as beams and joists.

Recent hurricanes and tornadoes, resulting in substantial property damage, have heightened the awareness for the need for improved construction materials and methods which provide greater structural strength without significantly increasing the cost of construction. Previous means of increasing structural strength, such as with the use of wooden trusses and steel beams, often add considerable weight or expense to the project or result in other problems complicating construction.

Standard dimensional lumber remains a preferred building material for use as structural members, which tie together a building and provide structural strength. The quality of the lumber significantly effects the strength of the structure and its ability to withstand destruction from strong external forces such as high winds or seismic activity. The substantial depletion of available old growth forest for harvesting along with other factors has greatly increased the cost of lumber and in particular the cost of high quality large dimensional lumber typically used as structural members in construction.

Therefore, there is a need for an apparatus which can be used to economically reinforce large dimensional lumber for use as structural members. Such an apparatus could be used to strengthen buildings in areas subject to high winds or seismic activity or to reduce the cost of construction by reducing the number of structural members necessary while maintaining adequate structural strength or by allowing the use of lower quality lumber which has been reinforced.

SUMMARY OF THE INVENTION

The present invention comprises a reinforcement apparatus for reinforcing a structural member such as a beam or joist. A cable or other tensile strength member, is secured under tension to anchor brackets mounted on opposite ends of a beam. The cable extends across a face of the beam and across and in engagement with a bearing bracket mounted to the face of the beam intermediate its ends. The cable bears a portion of the load applied to the beam intermediate its ends, resisting distortion of the beam and providing increased recovery ability.

First and second tension adjustment members are securable to the beam to engage the cable on opposite sides of the bearing bracket respectively to permit the tension on the cable to be adjusted. At least one end of the cable may be secured to an adjustable anchor bolt on the respective anchor bracket to further permit adjustment of the tension on the cable.

In a preferred embodiment, the bearing bracket includes a cable engaging member secured to a mounting plate mounted on the face of the structural member. The cable engaging member extends outwardly and downwardly from the mounting plate to form a cable receiving channel extending therebetween. The cable engaging member is also angled downward from opposite ends of the mounting plate so as to generally be V-shaped.

The reinforcement apparatus preferably includes two cables, an upper cable and a lower cable, extending between the anchor brackets, across the face of the structural member and into contact with an upper and a lower cable engaging member respectively which are spaced apart in generally vertical alignment on the bearing bracket. The first and second tension adjustment members on opposite sides of the bearing bracket preferably engage both the upper and lower cables for simultaneously adjusting the tension on both of the cables. Additional tension adjusting members may be utilized to provide greater flexibility in controlling and balancing the tension on the cables.

OBJECTS AND ADVANTAGES OF THE INVENTION

Therefore, the objects of this invention include: to provide an apparatus for reinforcing or strengthening dimensional lumber for use as a structural member such as a joist or beam; to provide such an apparatus which is relatively light weight; to provide such an apparatus which is relatively inexpensive; to provide such an apparatus which may be secured to the lumber under controlled conditions and prior to incorporation into a structure; to provide such an apparatus comprising a cable mounted to the structural member at opposite ends thereof and extending under tension across and in engagement with a cable engaging member secured to the structural member intermediate its ends; to provide such an apparatus which includes means for adjusting the tension in the cable; to provide such an apparatus which includes separate tension adjusting mechanisms which separately engage the portions of the cable on opposite sides of the cable engaging member; to provide such an apparatus in which the cable engaging member deflects the cable downward relative to the points at which the ends of the cable are secured to the ends of the structural member; to provide such an apparatus which utilizes two cables extending under tension, one above the other across the structural member and across and into engagement with vertically aligned cable engaging members mounted intermediate the ends of the structural member; to provide such an apparatus which can be used to increase the strength of a structure; to provide such a device which can be employed together with other reinforcing devices; to provide such an apparatus which can be used to reduce the number of structural members necessary without reducing the strength of the building; to provide such an apparatus which can be used to permit use of lower quality lumber without reducing the strength of the building; and to provide such an apparatus which is particularly well adapted for its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
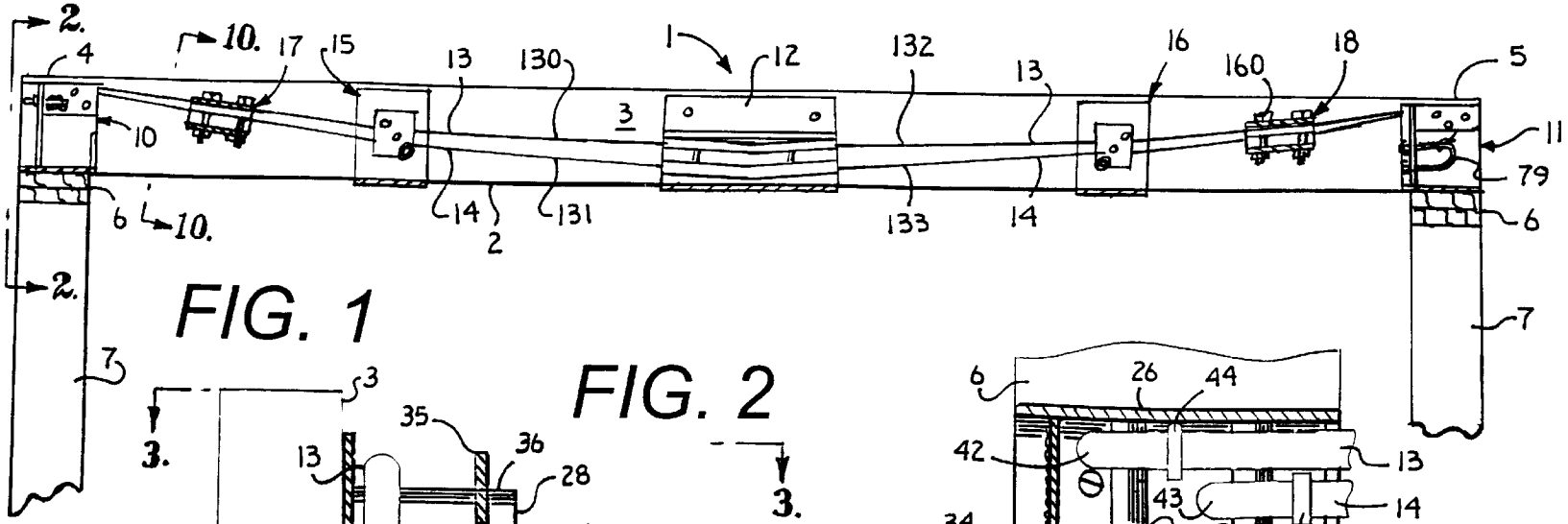
FIG. 1 is a front elevational view of a reinforcing apparatus of the present invention secured to a beam wherein the apparatus includes an upper and a lower cable secured to and extending between a first end anchor bracket and a second end anchor bracket, the cables extending under tension across and in engagement with cable engaging members on a bearing bracket.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The disclosure including the drawings and specification of the provisional application Ser. No. 60/002,616 entitled MULTI-STRESS CONVERTER TRUSS is incorporated herein by reference.

Referring to the drawings in more detail, the reference numeral 1 refers to a reinforcing apparatus of the present invention. The reinforcing apparatus is shown secured to a structural member 2, such as a joist or beam, which is formed from relatively large dimensional lumber, such as a sixteen foot two by six, two by eight, two by ten or two by twelve. The terms structural member, beam and joist are used interchangeably herein. The apparatus 1 is generally shown secured to a first or front face 3 of the beam 2. First and second ends 4 and 5 of the beam 2 are supported on top plates 6 which are in turn supported by a plurality of studs 7.

Directional references herein shall be with reference to the reinforcing apparatus 1 as shown in FIG. 1, wherein FIG. 1 is oriented lengthwise with respect to the sheet. When viewing FIG. 1, references to left and right will correspond to the viewer's left and right sides, up will correspond to the top of the sheet and down will correspond to the bottom of the sheet. Other directional references will be based on the same orientation.

The reinforcing apparatus 1 generally includes a first end anchor bracket 10, a second end anchor bracket 11, a bearing bracket 12, an upper cable 13, a lower cable 14, first and second sliding tension adjustment mechanisms 15 and 16 and first and second clamping tension adjustment mechanisms 17 and 18. In general, the upper and lower cables 13 and 14 are secured to and extend under tension between the first end and second end anchor brackets 10 and 11 and across and in engagement with the bearing bracket 12 such that the cables bear a portion of the load applied to the beam 2 intermediate its ends 4 and 5, resisting distortion of the beam 2 and providing increased recovery ability of the beam 2.

Figure 2:
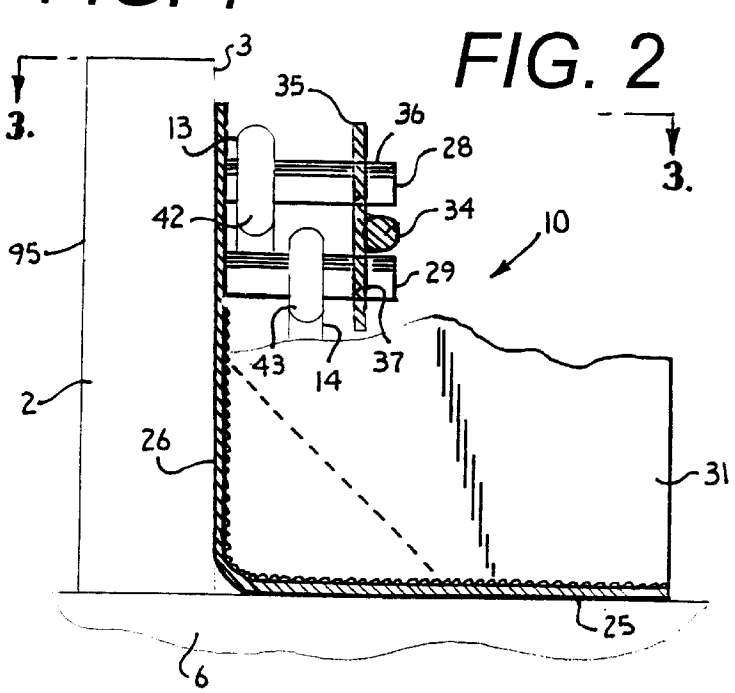
FIG. 2 is an enlarged and fragmentary end elevational view taken generally along line 2—2 of FIG. 1 showing the first end anchor bracket with portions broken away to show detail.
Figure 3:
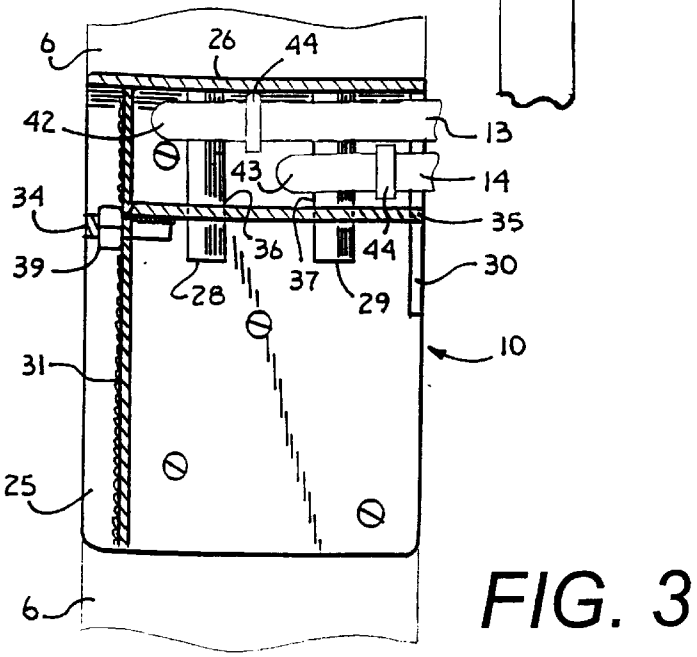
FIG. 3 is a fragmentary top plan view taken generally along line 3—3 of FIG. 2 showing the first end anchor bracket.

As best seen in FIGS. 2 and 3, the first or left end anchor bracket 10 is generally L-shaped and includes a base plate 25 and a beam-connecting plate 26. The beam-connecting plate 26 is secured to the front face 3 of the beam 2 at the first end 4 thereof such that the base plate 25 extends transverse to the beam face 3 and flush with a lower end thereof such that the base plate 25 may be secured to the top plate 6 when the beam 2 is positioned thereon. Conventional L-shaped support brackets (not shown) may be secured to the rear face of the beam 2 at the ends 3 and 4 for securing and supporting the beam 2 relative to the top plates 6.

Upper and lower anchor pins or anchor members 28 and 29 are secured to and extend forward from and transverse to the beam-connecting plate 26 in spaced apart alignment. The lower anchor pin 29 is preferably positioned in front of and below the upper anchor pin 28.

An angled web 30 extends between the beam connecting plate 26 and the base plate 25 generally along a right side thereof to strengthen the anchor bracket 10. A connecting web 31 is secured to and extends forward from and transverse to the beam-connecting plate 26 on a left side thereof and is secured to and extends above and transverse to the base plate 25. A horizontally aligned orifice or slot 32 (not shown but similar to the slot shown in FIG. 5) is formed in the connecting web 31.

The slot 32 is adapted to receive a mounting bolt 34 which is welded to and generally extends away from an end of a first anchor pin support plate 35 in parallel alignment therewith. The anchor pin support plate 35 includes an upper and a lower pin receiving aperture 36 and 37 extending therethrough. The pin receiving apertures 36 and 37 are positioned on the anchor pin support plate 35 in corresponding alignment with the upper and lower anchor pins 28 ad 29 respectively. The anchor pin support plate 35 is securable to the connecting web 31 through insertion of the mounting bolt 34 in the slot 32 and advancement of the anchor pin support plate 35 toward the anchor pins 28 and 29 until the anchor pin support plate 35 extends across at least a portion of the anchor pins 28 and 29 such that portions of the anchor pins 28 and 29 extend into the apertures 36 and 37 respectively in the support plate 35. The anchor pin support plate 35 is secured in place by tightening down a nut 39 on mounting bolt 34.

First ends 42 and 43 of the upper and lower cables 13 and 14 are secured to the upper and lower anchor pins 28 and 29 respectively by wrapping the ends 42 and 43 around the pins 28 and 29 respectively and securing ends 42 and 43 back onto themselves with a cable clamp 44 or the like. The anchor pin support plate 35 is removed to provide access to the anchor pins 28 and 29 to permit securement of the cable ends 42 and 43 thereto. When the cable ends 42 and 43 are secured to the anchor pins 42 and 43 the anchor pin support plate 35 is secured in place such that the anchor pin support plate 35 provides further support for the anchor pins 28 and 29 extending therethrough.

Figure 5:
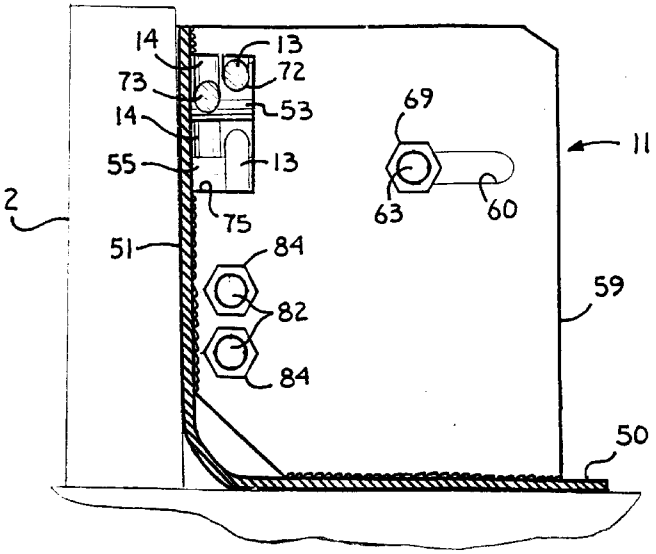
FIG. 5 is a fragmentary cross-sectional view taken generally along line 5—5 of FIG. 4 showing the second end anchor bracket.
Figure 4:
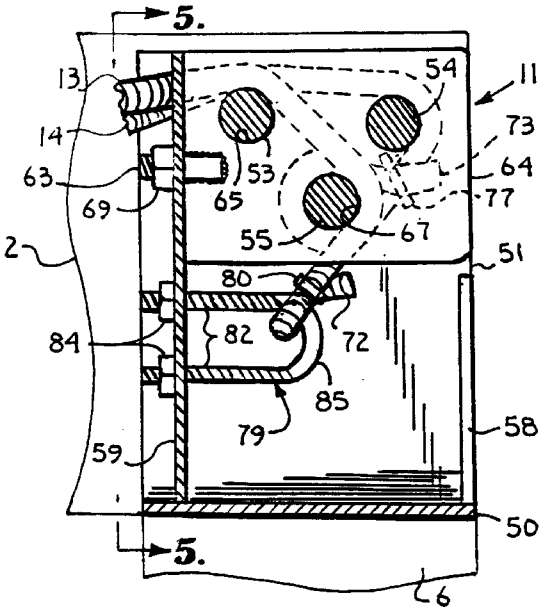
FIG. 4 is an enlarged and fragmentary front elevational view of the second end anchor bracket as shown in FIG. 1.

The second end anchor bracket 11 as shown in FIGS. 4 and 5 is generally L-shaped and includes a base plate 50 and a beam-connecting plate 51. The beam-connecting plate 51 is secured to the face of the beam 2 at the second end 5 thereof such that the base plate 50 extends transverse to the beam face 3 and flush with a lower end thereof such that the base plate 50 may be secured to the top plate 6 when the beam 2 is positioned thereon.

First, second and third anchor pins or anchor members 53, 54 and 55 are secured to and extend forward from and transverse to the beam-connecting plate 51 in spaced apart alignment. The first anchor pin 53 is positioned toward the left side and an upper end of the beam-connecting plate 51. The second anchor pin 54 is positioned to the right of and slightly below the first anchor pin 53. The third anchor pin 55 is positioned below and between the first and second anchor pins 53 and 54.

An angled web 58 extends between the beam connecting plate 51 and the base plate 50 generally along a right side thereof to strengthen the anchor bracket 11. A connecting web 59 is secured to and extends forward from and transverse to the beam-connecting plate 51 on a left side thereof and is secured to and extends above and transverse to the base plate 50. A horizontally aligned orifice or slot 60 is formed in the connecting web 59. The first end and second end anchor brackets 10 and 11 are designed to place the same amount of tension on both cables 13 and 14.

The slot 60 is adapted to receive a mounting bolt 63 which is welded to and generally extends away from an end of a second anchor pin support plate 64 in parallel alignment therewith. The anchor pin support plate 64 includes first, second and third pin receiving apertures 65, 66 and 67 extending therethrough. The pin receiving apertures 65, 66 and 67 are positioned on the anchor pin support plate 64 in corresponding alignment with the first, second and third anchor pins 53, 54 and 55 respectively. The anchor pin support plate 64 is securable to the connecting web 59 through insertion of the mounting bolt 63 in the slot 60 and subsequent advancement of the anchor pin support plate 64 toward the anchor pins 53, 54 and 55 until the anchor pin support plate 64 extends across at least a portion of the anchor pins 53, 54 and 55 such that portions of the anchor pins 53, 54 and 55 extend into the apertures 65, 66 and 67 respectively in the support plate 64. The anchor pin support plate 64 is then secured in place by tightening down a nut 69 on mounting bolt 63.

Second ends 72 and 73 of the upper and lower cables 13 and 14 are secured to the anchor pins 53, 54 and 55 as described below. The second ends 72 and 73 are extended through an opening 75 in the connecting web 59 generally proximate an upper end thereof and proximate the beam connecting plate 51. With the second anchor support plate 64 removed, the second end 72 of the upper cable 13 is extended through the opening 75 across the upper periphery of the first anchor pin 53, around the right side of the second anchor pin 54 and down and around the third anchor pin 55 and back onto itself where it is secured thereto with a cable clamp 77 or the like after being pulled taught to a selected tension.

The second end 73 of the lower cable 14 is extended through the opening 75, around an upper periphery of the first anchor pin 53, down around the right side of the third anchor pin 55 and down to an anchor bolt 79 around which the lower cable second end 73 is wrapped back onto itself and secured thereto by a cable clamp 80 or the like after being pulled taught to a selected tension. The anchor bolt 79 preferable comprises a U-bolt having threaded legs 82 extending through bolt holes in the connecting web 59 and secured in place by nuts 84. The lower cable second end 73 is generally wrapped around the arch 85 of the U-bolt 79. The tension on the lower cable 13 is adjustable by turning the nuts 84 to either draw the arch 85 of the anchor bolt 79 and the lower cable second end 73 toward or away from the connecting web 59. When the cable second ends 72 and 73 are secured to the anchor pins 53, 54 and 55 and the anchor bolt 79, the anchor pin support plate 64 is secured in place such that the anchor pin support plate 64 provides further support for the anchor pins 53, 54 and 55 extending therethrough.

Figure 6:
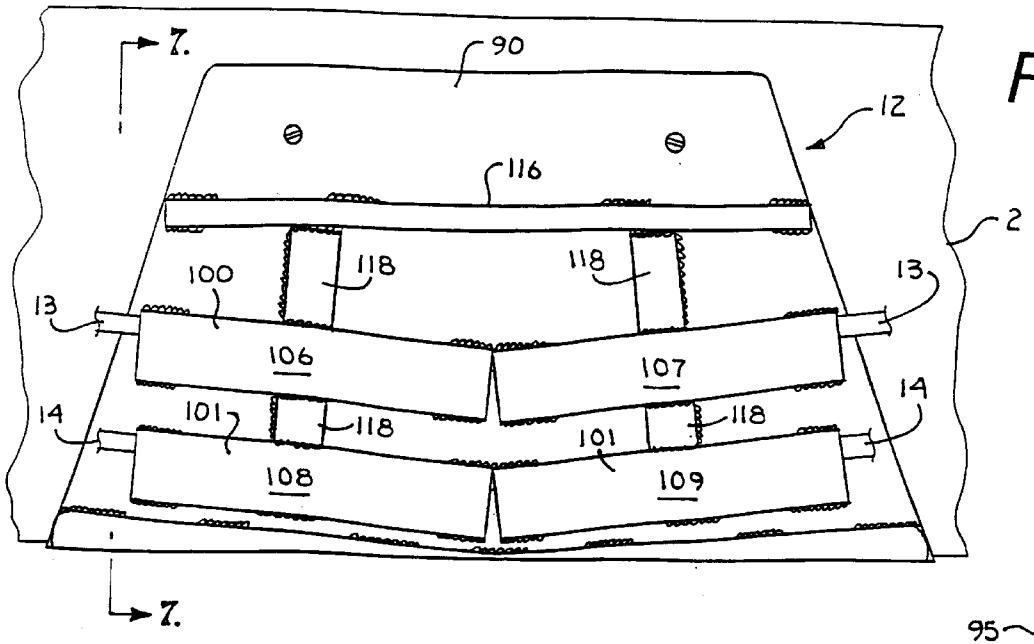
FIG. 6 is an enlarged and fragmentary front elevational view of the apparatus as shown in FIG. 1 showing the bearing bracket.
Figure 7:
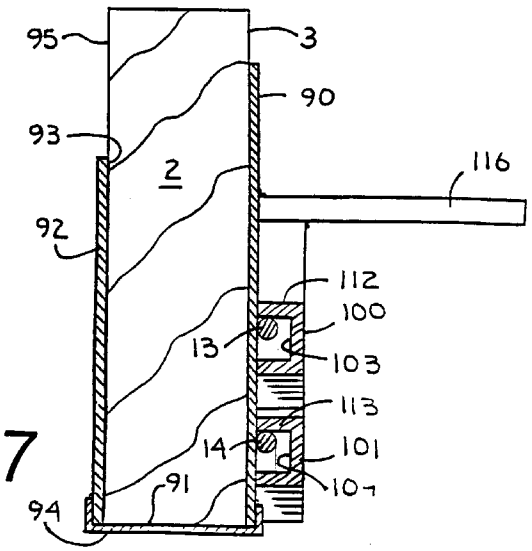
FIG. 7 is a cross-sectional view taken generally along line 7—7 of FIG. 6 generally showing an end view of the bearing bracket.

Referring to FIGS. 6 and 7, the bearing bracket 12 includes front, bottom and rear mounting plates 90, 91 and 92 secured together and forming a beam receiving channel 93. The bearing bracket 12 is slid onto a beam 2 from a lower end thereof such that the front mounting plate 90 is positioned flush against the front face 3 of the beam 2, the bottom mounting plate 91 is positioned flush against a bottom face 94 of the beam 2, and the rear mounting plate 92 is positioned flush against a rear face 95 of the beam 2. The bottom mounting plate 94 is generally thinner to avoid interference with extrinsic covering material, such as drywall. The bearing bracket 12 is secured to the beam 2 by wood screws or other conventional mounting means.

The bearing bracket 12 includes upper and lower cable engaging members or bearing members 100 and 101 mounted to and extending forward from the front mounting plate 90 in vertical spaced alignment. The cable engaging members 100 and 101 are preferably formed from C-channel mounted to the front mounting plate 90 so as to form a cable receiving channel 103 and 104 respectively therebetween. Each cable engaging member 100 and 101 is preferably formed from two sections of C-channel angled slightly downward from opposite sides of the front mounting plate 90 such that each cable engaging member 100 and 101 and the corresponding cable receiving channels 103 and 104 are generally V-shaped. The two angled portions of C-channel forming the upper cable engaging member 100 are identified by the reference numerals 106 and 107 and the two angled portions of C-channel forming the lower cable engaging member 101 are identified by the reference numerals 108 and 109.

The upper and lower cables 13 and 14 are threaded through the upper and lower cable receiving channels 103 and 104 prior to attachment of the upper and lower cable second ends 72 and 73 to the second end anchoring bracket 11. The cable engaging members 100 and 101 are positioned on the front mounting plate 90 below the anchor pins 28 and 29 and 53, 54 and 55 on the first end and second end anchoring brackets 10 and 11 such that the cables 13 and 14 are generally deflected downward by the bearing bracket 12. The cables 13 and 14 engage the underside of upper arms 112 and 113 of the upper and lower cable engaging members 100 and 101 respectively and thereby generally exert a vertical force component on the bearing bracket and resist further downward deflection of the beam thereby. A layer of rubber or other cushioning material (not shown) may be secured to the underside of the upper arms 112 and 113 to reduce or muffle noised created by the engagement of the cable engaging members 100 and 101 by the cables 13 and 14 respectively.

It is foreseen that the cable engaging members 100 and 101 could be of a wide variety of configurations at least providing a surface for engagement by the cables 13 and 14 against which to act. The cable engaging members in a broad sense could be a post extending perpendicular to the beam and across which one or more cables under tension would extend. The cable engaging member preferably forms a channel or groove sized for receiving a cable. The cable engaging member preferably extends at least outwardly and downwardly relative to the front mounting plate 90 to provide a downwardly facing surface for engagement by the cable and a lip or surface extending to the side of the cable opposite the face of the mounting plate 90 to prevent the cable from slipping out from under the downwardly facing surface.

The cable engaging members could be oriented horizontally across the front mounting plate in horizontal alignment with a cable extending horizontally between the anchor brackets 10 and 11. It is also foreseen that the cable engaging members could be formed in an inverted V-shape and positioned above the anchor pins 28 and 29 and 53, 54 and 55 such that the cables 13 and 14 exert a downwardly directed force on the bearing bracket 12 and the beam 2 and resist upward deflection thereof such as is associated with seismic activity.

A counter-weight 116 is mounted to the front mounting plate 90 above the cable engaging members 100 and 101 and extends forward therefrom. The counter-weight 116 helps counter balance the upward and outward torsional force exerted on the beam 2 by the upper and lower cables 13 and 14 pulling upward on the upper and lower cable engaging members 100 and 101 respectively. Additional sections of C-channel are secured to the front mounting plate 90 so as to extend generally vertically between the upper and lower cable engaging members 100 and 101 and the counter-weight 116 to function as braces 118.

Figure 9:
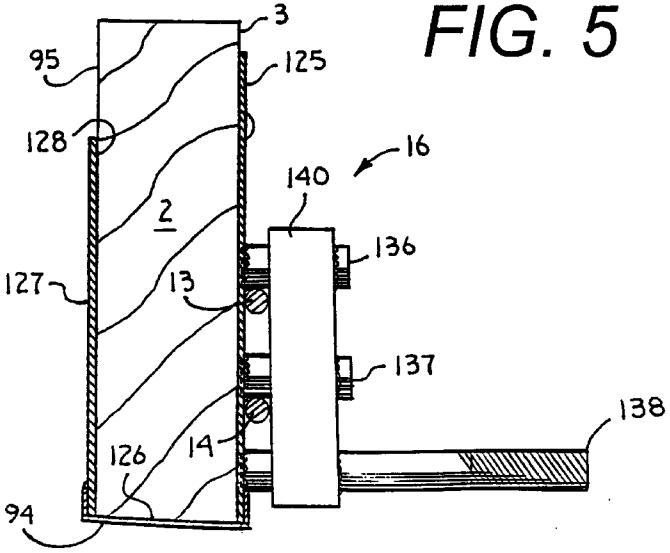
FIG. 9 is a cross-sectional view taken generally along line 9—9 of FIG. 8 generally showing an end view of the sliding tension adjustment mechanism.
Figure 8:
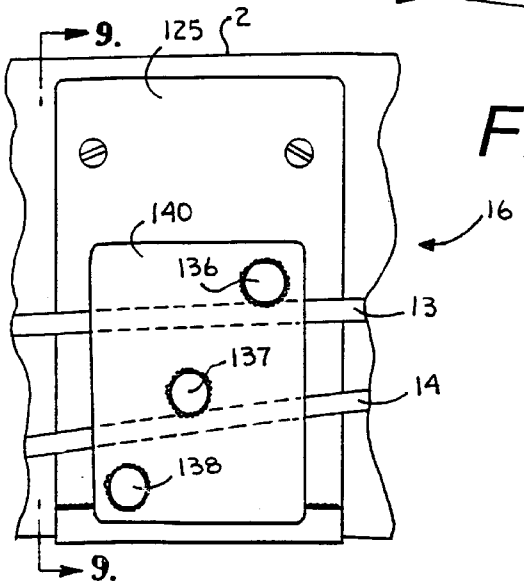
FIG. 8 is an enlarged and fragmentary front elevational view of the apparatus as shown in FIG. 1 showing a sliding tension adjusting mechanism engaging the upper and lower cables.

The second sliding tension adjustment mechanism 16 is shown in detail in FIGS. 8 and 9. The first sliding tension adjustment mechanism 15 is generally a mirror image of the second sliding tension adjustment mechanism 16. The tension adjustment mechanism 16 includes front, bottom and rear mounting plates 125, 126 and 127 secured together and forming a beam receiving channel 128 therebetween. The adjustment mechanism 16 is slid onto a beam 2 from a lower end there of such that the front mounting plate 125 is positioned flush against the front face 3 of the beam 2, the bottom mounting plate 126 is positioned flush against a bottom face 94 of the beam 2, and the rear mounting plate 127 is positioned flush against a rear face 95 of the beam 2.

The adjustment mechanism 16 is secured to the beam 2 by wood screws or other conventional mounting means after it is slid into place to achieve a desired tension on the cables 13 and 14. The first sliding tension adjustment mechanism 15 engages and is used to adjust the tension principally on left side portions 130 and 131 of the upper and lower cables 13 and 14 which extend from the first end anchor bracket 10 to the bearing bracket 12. The second sliding tension adjustment mechanism 16 engages and is used to adjust the tension principally on right side portions 132 and 133 of the upper and lower cables 13 and 14 which extend from the second end anchor bracket 11 to the bearing bracket 12.

Upper and lower cable engaging pins 136 and 137 and a counter-weight pin 138 are secured to and extend forward from the front mounting plate 125. A pin support plate 140 is secured to the pins 136, 137 and 138 in spaced and parallel relation to the front mounting plate 125. The first and second sliding tension adjustment mechanisms 15 and 16 are secured to the beam 2 prior to attachment of the cables 13 and 14. After the adjustment mechanisms 15 and 16 are secured to the beam 2 the cables 13 and 14 are threaded therethrough. With reference to the second adjustment mechanism 16, the upper cable 13 is threaded between the upper and lower cable engaging pins 136 and 137 and the lower cable 14 is threaded between the lower cable engaging pin 137 and the counter-weight pin 138 such that the cables 13 and 14, when placed under tension, generally engage lower surfaces of the cable engaging pins 136 and 137 respectfully adding an additional point of downward deflection of the cables 13 and 14.

Sliding the second adjustment mechanism 16 to the right increases the tension on the upper and lower cable right side portions 132 and 133 and sliding the second adjustment mechanism 16 to the left decreases the tension on the upper and lower cable right side portions 132 and 133. The upper cable engaging pin 136 is offset to the right of the lower cable engaging pin 137 to compensate for the different angle at which the cables 13 and 14 engage the pins 136 and 137 and balance the degree to which the tension on each cable 13 and 14 is adjusted. The counter-weight pin 138 is relatively long with respect to cable engaging pins 136 and 137 and is adapted to receive weights such as washers to counteract the torsional forces created by engagement of the engaging pins 136 and 137 by the cable 13 and 14.

Figure 10:
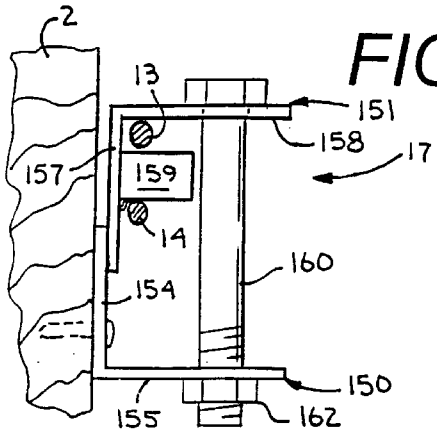
FIG. 10 is an enlarged and fragmentary view taken generally along line 10—10 of FIG. 1 and generally showing an end view of a clamping tension adjustment mechanism.

An end or side view of the first clamping tension adjustment mechanism 17 is shown in FIG. 10. The first and second clamping tension adjustment mechanisms 17 and 18 are identical. Each adjustment mechanism 17 and 18 includes a lower L-shaped bracket 150 and an upper L-shaped bracket 151. A first arm 154 of the lower bracket 150 is secured to the front face 3 of the beam 2 by wood screws. A second arm 155 extends forward therefrom. The upper bracket 151 includes a first arm 157 positioned against the first arm 154 of the lower bracket 150 and a second arm 158 extending forward therefrom in parallel and spaced apart relation to the second arm 155 of the lower bracket 150. A spacer 159 is secured to and extends forward from a front surface of the first arm 157 of the upper bracket 151 across the entire length thereof.

A pair of bolts 160 extend through aligned apertures (not shown) in the second arms 155 and 158 of the lower and upper brackets 150 and 151. Nuts 162 on bolts 160 may be rotated to draw the upper bracket 151 toward and away from the lower bracket 150. The tension adjustment mechanisms 17 and 18 are generally mounted on the front face 3 of the beam 2 in an angled orientation generally corresponding to the angle of the cables 13 and 14 thereacross.

The upper cable 13 is threaded through the space between the spacer 159 and the second arm 158 of the upper bracket 151. The lower cable 14 is threaded through the space between the spacer 159 and the second arm 155 of the lower bracket 150. When the second arm 158 of the upper bracket 151 is drawn toward the second arm 155 of the lower bracket 150, a lower surface of the upper bracket second arm 158 engages the upper cable 13 and a lower surface of the spacer 159 engages the lower cable 14 and draws the cables 13 and 14 toward the lower bracket second arm 155 thereby deflecting another portion of the cables 13 and 14 downward and increasing the tension thereon. Similarly, advancing the second arms 155 and 158 apart reduces the tension on the cables 13 and 14.

The first clamping tension adjustment mechanism 17 engages and is used to adjust the tension principally on the upper and lower cable, left side portions 130 and 131 simultaneously. The second clamping tension adjustment mechanism 18 engages and is used to adjust the tension principally on the upper and lower cable, right side portions 132 and 133 simultaneously. The clamping tension adjustment mechanisms 17 and 18 are preferably mounted closer to the beam ends 4 and 5 than the sliding tension adjustment mechanisms 15 and 16.

It is foreseen that a wide variety of means could be utilized for adjusting the tension on the cables 13 and 14 including turnbuckles or various clamping mechanisms and it is not intended to limit such means to those recited.

Although the reinforcing apparatus 1 has been described as utilizing two cables on one side of a beam thereof, it is foreseen that the reinforcing apparatus could utilize only a single cable on one side of the beam, a single cable on each side of the beam, or multiple cables on either or both sides of the beam. It is also foreseen that each cable could also comprise two distinct sections of cable, each section being secured to and extending from an end anchor bracket to an intermediate bearing bracket to which the section of cable is attached. Further, it is foreseen that linear tensile members of a type other than a standard twisted wire cable could be used such as rods, threaded rods, wires, single strand cables, pipes, reinforcing bars, chains, straps and the like.

It is believed that application of the reinforcing apparatus 1 utilizing cables of three-sixteenths of an inch diameter to a sixteen foot, two by six beam of Arkansas Soft Pine would increase the safe load bearing capacity from less than sixteen pounds per square foot up to approximately one hundred pounds per square foot. Further, it is believed that use of the apparatus 1 to reinforce a twenty four foot, two by six beam would increase the safe load bearing capacity from possibly less than two pounds per square foot to up to approximately sixty four pounds per square foot. Such strengthening would allow beams to be spaced farther apart or could be used to upgrade the strength of the beam arrangement by, for example, replacing every fifth beam with a beam having the apparatus 1 secured thereto.

It is to be understood that while certain forms of the present invention have been illustrated and described herein, it is not to be limited to the specific forms or arrangement of parts described and shown.

What is claimed and desired to be secured by letters patent is as follows:

1. A reinforcement apparatus for reinforcing a beam supported at first and second ends and having parallel opposite faces, said beam being configured to support a load intermediate said ends, said apparatus comprising:

(a) a first end anchor bracket connected to said first end of said beam;

(b) a second end anchor bracket connected to said second end of said beam;

(c) a bearing bracket including a mounting plate connected to said beam intermediate said first and second ends on a first of said opposite faces; said bearing bracket further including an upper and a lower cable engaging member secured to said mounting plate thereof and extending outwardly downwardly therefrom to form an upper and a lower cable receiving channel respectively extending therebetween; said upper and lower cable engaging members each including a first angled portion and a second angled portion angled downward from opposite sides of said mounting plate toward an intermediate point thereof;

(d) an upper cable connected to and extending between said first end anchor bracket and said second end anchor bracket; said upper cable extending across said first opposite face of said beam through said upper cable receiving channel and in contact with said upper cable engaging member; said upper cable being tightened to a selected tension;

(e) a lower cable connected to and extending between said first end anchor bracket and said second end anchor bracket below said upper cable; said lower cable extending across said first opposite face of said beam through said lower cable receiving channel and in contact with said lower cable engaging member; said lower cable being tightened to a selected tension; and (f) tension adjustment means engaging said upper and lower cables for simultaneously adjusting the tension on said upper and lower cables.

2. The reinforcement apparatus as in claim 1, wherein:

(a) said tension adjustment means comprises a clamp.

3. A reinforcement apparatus for reinforcing a beam supported at first and second ends and having parallel opposite faces, said beam being configured to support a load intermediate said ends, said apparatus comprising:

(a) a first end anchor bracket connected to said first end of said beam;

(b) a second end anchor bracket connected to said second end of said beam;

(c) a bearing bracket including a mounting plate connected to said beam intermediate said first and second ends on a first of said opposite faces; said bearing bracket further including an upper and a lower cable engaging member secured to said mounting plate thereof and extending outwardly downwardly therefrom to form an upper and a lower cable receiving channel respectively extending therebetween; said upper and lower cable engaging members each including a first angled portion and a second angled portion angled downward from opposite sides of said mounting plate toward an intermediate point thereof;

(d) an upper cable connected to and extending between said first end anchor bracket and said second end anchor bracket; said upper cable extending across said first opposite face of said beam through said upper cable receiving channel and in contact with said upper cable engaging member; said upper cable being tightened to a selected tension;

(e) a lower cable connected to and extending between said first end anchor bracket and said second end anchor bracket below said upper cable; said lower cable extending across said first opposite face of said beam through said lower cable receiving channel and in contact with said lower cable engaging member; said lower cable being tightened to a selected tension;

(f) first tension adjustment means engaging a first portion of each of said upper and lower cables extending from said first end anchor bracket to said bearing bracket for simultaneously adjusting the tension on said first portions of said upper and lower cables; and (g) second tension adjustment means engaging a second portion of each of said upper and lower cables extending from said second end anchor bracket to said bearing bracket for simultaneously adjusting the tension on said second portions of said upper and lower cables.

4. The reinforcement apparatus as in claim 3 wherein:

(a) said first tension adjustment means comprises a clamp; and (b) said second tension adjustment means comprises a clamp.

* * * * *